United States Patent [19]

Hetrick

[11] 4,244,122

[45] Jan. 13, 1981

[54] MODIFIED POWER UNIT FOR SNOW PLOWS

[75] Inventor: Vernon L. Hetrick, North Olmsted, Ohio

[73] Assignee: Meyer Products, Inc., Cleveland, Ohio

[21] Appl. No.: 44,938

[22] Filed: Jun. 4, 1979

[51] Int. Cl.[3] ..... E01H 5/06; F01B 29/04

[52] U.S. Cl. ..... 37/41; 37/42 R; 60/477; 91/54; 92/59; 254/93 R; 417/238

[58] Field of Search ..... 37/42 R, 41; 91/54; 92/59; 417/237, 238; 60/477–482, 458; 254/93 R, 93 H

[56] References Cited

U.S. PATENT DOCUMENTS

| | | | |
|---|---|---|---|
| 1,763,404 | 6/1930 | McBride | 60/478 |
| 1,768,799 | 7/1930 | Stanley | 92/59 |
| 2,044,044 | 6/1936 | Anthony | 60/482 X |
| 2,255,984 | 9/1941 | Pfauser | 60/478 |
| 2,324,635 | 7/1943 | Meyer | 60/481 |
| 2,414,484 | 1/1947 | Page | 60/481 |
| 3,706,144 | 12/1972 | Miceli | 37/42 |
| 3,773,074 | 11/1973 | Miceli | 137/596 |

FOREIGN PATENT DOCUMENTS

| | | | |
|---|---|---|---|
| 527546 | 10/1940 | United Kingdom | 417/237 |

*Primary Examiner*—Steven A. Bratlie

*Attorney, Agent, or Firm*—Meyer, Tilberry & Body

[57] ABSTRACT

An arrangement for modifying a plow blade power unit of the type positioned between the mounting frame on the front of a vehicle and a plow blade lift arm, to a unit for creating pressurized fluid from a remote location. Modification enables a basically similar power unit to be utilized in both remote and direct operational environments with only minor substitution of interchangable parts. A piston-cylinder unit which enables direct lifting of a plow blade is replaced by a modified, but similar, cylindrical element for use in indirect lifting of a plow blade by fluid under pressure.

8 Claims, 6 Drawing Figures

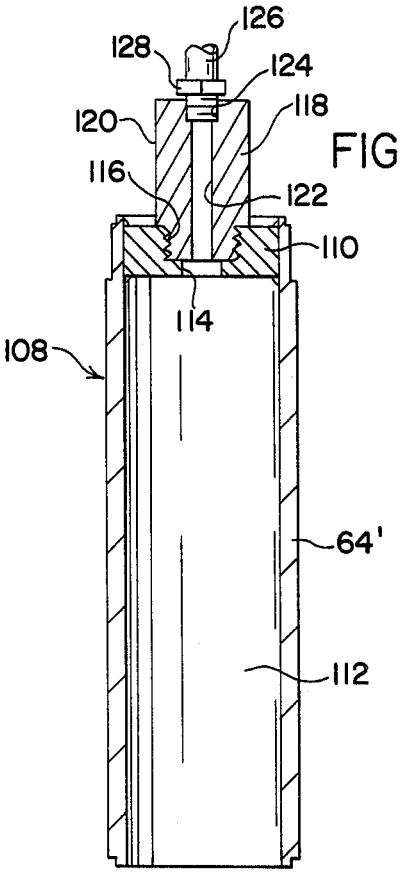
FIG. 3
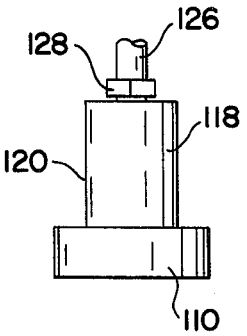
FIG. 4
FIG. 6
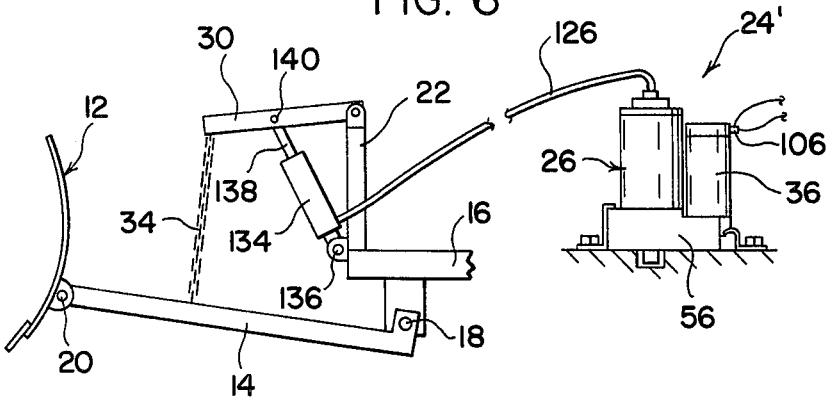

MODIFIED POWER UNIT FOR SNOW PLOWS

BACKGROUND OF THE INVENTION

This invention relates to the art of hydraulic power units and, more particularly, to the piston-cylinder portion of such hydraulic units.

Particular utility of this invention is found in a power unit for controlling operation of a plow blade mounted on a vehicle, and the invention will be described herein with reference thereto. However, it will be appreciated that the invention has broader applications and may be used for controlling other devices.

Plow blades are often mounted on the front of a vehicle for the purpose of being pushed by the vehicle to clear snow, ice or other debris when the plow blade is lowered to a roadway. The plow blade is pivotally connected to a mounting frame secured to a frame portion of the vehicle and is also connected to a movable lift arm by a link chain. The lift arm is also supported by the mounting frame and is movable vertically, relative to the vehicle, to cause up and down movement of the plow blade relative to the roadway. A power unit is positioned between the mounting frame and the lift arm. The power unit generally includes a piston-cylinder unit which is functionally connected between the lift arm and mounting frame to cause the lift arm to raise when the piston is extended from within the cylinder, and to lower when the piston retracts into the cylinder. Usually, such retraction is caused by the weight of the plow blade after relieving the hydraulic pressure in the cylinder. In addition to the blade lifting and lowering piston-cylinder unit, the power unit for positioning the plow blade includes a motor-pump unit, and a number of control valves for additional hydraulic piston-cylinder units operable to achieve other blade displacement functions.

In this respect, the plow blade is usually power controlled for sideways angling as well as up and down movement. The additional piston-cylinder units mentioned above are provided on the plow blade unit for this purpose. U.S. Pat. No. 3,706,144 describes a device of the type discussed above and discloses an integral power unit assembly mounted at the front of a vehicle. The integral power unit advantageously incorporates the lift piston-cylinder, the motor-pump and the control valves in a unitary assembly. An integral power unit of this character is advantageous from the standpoint of compactness, and manufacturing and mounting ease and economy. One structural example of such a power unit is shown in U.S. Pat. No. 3,773,074. The disclosures of the above two patents are incorporated herein by reference.

While such an integral power unit lends itself to mounting on the front of a vehicle, by such mounting it is exposed to weather and other undesirable exterior factors. Some purchasers of plow blade arrangements prefer that the power unit components including the motor-pump and valves not be so exposed and, thus, specify that the hydraulic controls and motor-pump unit be internal to the vehicle, such as within the engine compartment. The location of a plow blade relative to a vehicle and the number of plow blades provided on the vehicle also has bearing upon location of the power unit components relative to the vehicle. In this respect, such an integral power unit heretofore had to be mounted on the vehicle front because of the structural relationship between the lift piston-cylinder and motor-pump units.

Thus, use of the integral power unit was limited to front end mounting applications and, accordingly, all of the advantages of manufacturing and mounting economy and compactness were likewise limited. Prior to the present invention, specifications of a purchaser requiring a remote location for the controls of a plow blade power unit could not be met with an integral power unit of the character described above and required manufacturing an entirely different unit.

SUMMARY OF THE INVENTION

The present invention provides a modification applicable to the lift piston-cylinder of a power unit of the character described above which enables the power unit to be mounted other than on the front of a vehicle and thus operable to control blade movements from a remote location such as within the engine compartment. Advantageously, such a modification involves interchangeable parts in the basic integral power unit, whereby the latter can be readily adapted for mounting either on the vehicle front or remote therefrom. Basically, such interchangeability involves the lift piston-cylinder unit and, more particularly, a sleeve assembly interchangeable with piston and sleeve components of the unit to provide hydraulic fluid flow through the cylinder when the unit is not front mounted. Such fluid flow is directed from the cylinder to a lift piston-cylinder unit associated with the plow blade unit.

It is a principal object of the present invention to provide a modification for a hydraulic power unit for a vehicle mounted plow blade which provides increased versatility for the power unit.

A further object is the provision of a modification of the foregoing character which enables use of the power unit for direct or indirect blade displacement.

Another object is the provision of a modification of the foregoing character which enables selective use of the lift piston-cylinder of the unit for direct displacement of the piston associated therewith or for directing fluid flow to a remotely located piston-cylinder unit for displacement of the piston of the latter unit.

Yet another object is the provision of a modification of the foregoing character by which piston and piston sleeve components of the lift piston-cylinder of a power unit are replaced by an auxiliary sleeve assembly to convert the unit from one providing direct piston displacement to one providing fluid flow through the cylinder for use at a location remote from the power unit.

BRIEF DESCRIPTION OF THE DRAWINGS

The invention may take physical form in a variety of parts and arrangements of parts, a preferred embodiment of which is described below and illustrated in the accompanying drawings which form a part hereof and wherein:

FIG. 3 is a cross-sectional elevation view of the sleeve assembly for modifying the power unit in accordance with the present invention;

FIG. 4 is an elevational view of the end wall and fitting portion of the sleeve assembly shown in FIG. 3;

DESCRIPTION OF THE PREFERRED EMBODIMENT

Figure 1:
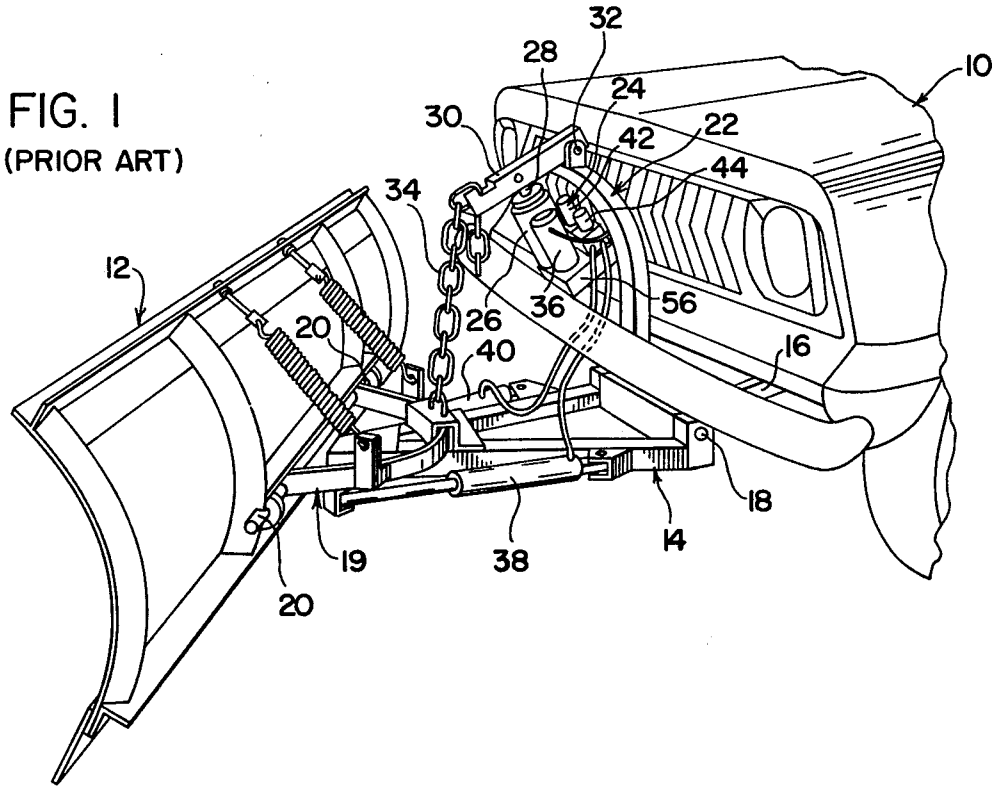
FIG. 1 (PRIOR ART)
FIG. 1 is a pictorial view illustrating a prior art arrangement of a plow blade and a hydraulic power unit therefor mounted on the front of a vehicle, and which power unit includes a lift piston-cylinder for directly lifting and lowering the plow blade.

Referring now to the drawings wherein the showings are for the purpose of illustrating a preferred embodiment of the invention only and not for the purpose of limiting the same, FIG. 1 shows a portion of the front of a vehicle 10 on which a standard plow blade 12 is mounted by means of an A-frame 14. Connection of A-frame 14 to a frame portion 16 of vehicle 10 is accomplished by pivot pins 18. Plow blade 12 is supported for pivotal movement horizontally relative to A-frame 14 by means of a blade mounting assembly 19 and is connected to the assembly 19 by pivot pins 20. Extending upwardly from frame portion 16 of the vehicle is a blade and power unit support frame 22. Movement of plow blade 12 is accomplished by and through a power unit, generally indicated by reference numeral 24, which is suitably mounted on support frame 22. Power unit 24 and the operation thereof is similar to that shown in U.S. Pat. No. 3,773,074 referred to herein. For the purpose of understanding the present invention, power unit 24 includes a lift piston-cylinder unit 26 which includes a piston rod or ram member 28 having its outer end pivotally connected to a lift arm 30. Lift arm 30 has one end pivotally connected by pin 32 to support frame 22, and the other end of lift arm 30 has one end of a chain 34 connected thereto. The other end of chain 34 is connected to A-frame 14. Vertical displacement of lift arm 30 in opposite directions about the axis of pin 32 by extension and retraction of piston rod 28 of the piston-cylinder unit raises and lowers plow blade 12 relative to a roadway under the vehicle. Power unit 24 further includes an electrically operated motor-pump unit 36 which pressurizes hydraulic fluid for use within piston-cylinder unit 26. Hydraulic cylinders 38 and 40 are mounted between A-frame 14 and blade mounting assembly 19 to angle plow blade 12 when actuated by power unit 24. In this respect, power unit 24 includes hydraulic control valves 42 and 44 which are connected to hydraulic cylinders 38 and 40, respectively, to provide actuation of the cylinders under the control of the power unit. Thus, the power unit provides all of the hydraulic system components and flow control devices in a compact unit mounted on the front of the vehicle.

Figure 2:
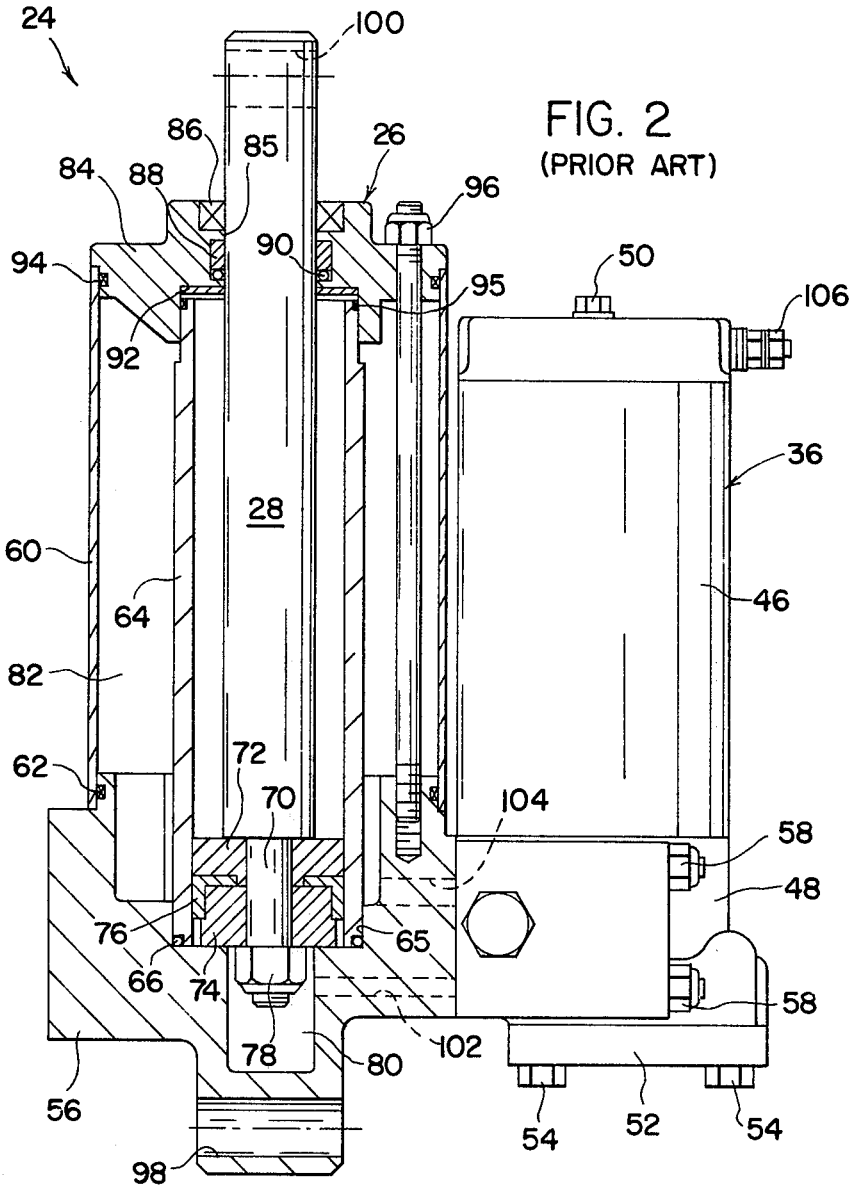
FIG. 2 (PRIOR ART)
FIG. 2 is an elevational view, partially in section, of the lift piston-cylinder portion of the power unit shown in FIG. 1.

FIG. 2 illustrates in greater detail the piston-cylinder unit 26 and motor-pump unit 36 of power unit 24. Motor-pump unit 36 includes an electric motor 46 and a gear type pump 48. Motor portion 46 is secured to gear pump 48 by elongated bolts 50 extending vertically through the motor housing and into threaded engagement with suitable threaded bores in the pump housing. A cover plate 52 is secured to the bottom of pump 48 such as by bolts 54, and the motor-pump unit is secured by bolts 58 to a base portion 56 providing a common base for all of the components of power unit 24. Piston-cylinder unit 26 includes an outer cylindrical housing member 60 positioned on base portion 56 and suitably sealed with respect thereto by seal 62. An inner cylindrical piston sleeve member 64 is located within housing member 60 and coaxial therewith. The lower end of sleeve 64 is received in a recess 65 in base 56 and is suitably sealed with respect thereto by a seal 66. Piston rod or ram member 28 extends into piston sleeve member 64 and is provided at its lower or inner end with a shank portion 70. Shank portion 70 receives a piston assembly defined by cylindrical members 72 and 74 having a sealing member 76 interposed therebetween. The piston assembly is retained on shank portion 70 by a nut 78.

Base portion 56 is provided with a recess 80 beneath the piston assembly in flow communication with the gear pump, as set forth more fully hereinafter, and housing member 60 and inner piston sleeve 64 are radially spaced from one another to provide a circumferential reservoir 82 for hydraulic fluid. A top or cover member 84 has a centrally located opening 85 therethrough slidably receiving the upper or outer end of piston rod 28. Suitable seals 86, 88 and 90 are provided in opening 85 around piston rod 28. A bearing washer 92 is also provided between the upper end of piston sleeve 64 and cover 84. Cover member 84 receives the upper ends of outer cylindrical member 60 and piston sleeve 64 and is suitably sealed with respect thereto by seals 94 and 95, respectively. Bolts 96 tightly clamp cover member 84 and base portion 56 together, with outer cylindrical member 60 and piston sleeve member 64 interposed therebetween.

Base portion 56 has a downwardly projecting lug portion thereon having a lateral opening 98 therethrough for mounting base portion 56 and thus power unit 24 on the front of a vehicle. The upper or outer end of piston rod 28 also has a lateral opening 100 therethrough for receiving a pin by which the piston rod is connected to lift arm 30 for raising and lowering of the plow blade. As mentioned above, recess 80 in base 56 is in fluid communication with gear pump 48 and, for this purpose, base 56 is provided with fluid passage 102. Reservoir space 82 is also in fluid communication with gear pump 48, by means of fluid passage 104 in base 56. An electrical terminal 106 is provided on motor 46 for connection with a suitable voltage source, such as the battery of the vehicle.

Piston-cylinder unit 26, with piston rod 28 and piston sleeve member 64 therein as described above, provides a first operational arrangement for power unit 24 by which piston rod 28 is adapted to be extended and retracted to directly raise and lower plow blade 12 through arm 30. In this respect, motor-pump unit 36 is operable to deliver hydraulic fluid from reservoir 82 through passage 104 to pump 48 and from the pump through passage 102 into recess 80 beneath the piston assembly on rod member 28. The hydraulic fluid under pressure displaces the piston assembly and thus piston rod member 28 upward in piston sleeve member 64, causing lift arm 30 to raise plow blade 12. When it is desired to lower the plow blade, hydraulic controls within pump 48 of the motor-pump unit connect fluid passages 102 and 104, thus allowing the pressurized fluid behind the piston to return to reservoir 82. As the pressurized fluid is released from behind the piston assembly, rod 28 moves downwardly within piston sleeve 64 causing lift arm 30 and the plow blade to be lowered. It will be appreciated from the foregoing description that the power unit must be mounted on the front of the vehicle to achieve blade raising and lowering functions.

In accordance with the present invention, a power unit as described above is adapted to be modified to provide a power unit of the same basic structure which is operable to deliver fluid to a point remote from the power unit, as opposed to delivering fluid under pressure behind the piston component as described above. Such a modification enables the basic power unit to be mounted remote from the front of a vehicle and to deliver fluid under pressure to a blade lift piston-cylinder assembly associated with the blade mounting frame.

In the embodiment disclosed, such modification is achieved by replacing the piston assembly and rod and piston sleeve 64 with the inner sleeve assembly 108 illustrated in FIG. 3. Sleeve assembly 108 includes a sleeve member 64' identical to piston sleeve member 64. The upper end of sleeve 64' is provided with an apertured end wall member 110 which is preferably secured to the inner surface of sleeve 64' as by welding. Sleeve 64' and member 110 provide a cavity 112 within the sleeve for the purpose set forth hereinafter. A central aperture 114 is provided axially through wall member 110 and is internally threaded as at 116 to receive an externally threaded nipple 118. Nipple 118 is cylindrical, has an outer surface 120 corresponding to the diameter of piston rod 28, and has an aperture 122 axially therethrough. The upper end of aperture 122 is internally threaded as at 124 for connection with fluid hose 126 by means of a threaded fitting 128. Since sleeve 64' is identical to piston sleeve 64 in the basic power unit, it will be appreciated that end wall 110 and nipple 118 can be preassembled, as shown in FIG. 4, and stored until such time as a basic unit is to be modified. Then, either the piston sleeve 64 from the unit to be modified, or a separate sleeve can be used to provide sleeve assembly 108 by attaching end wall member 110 thereto.

Figure 5:
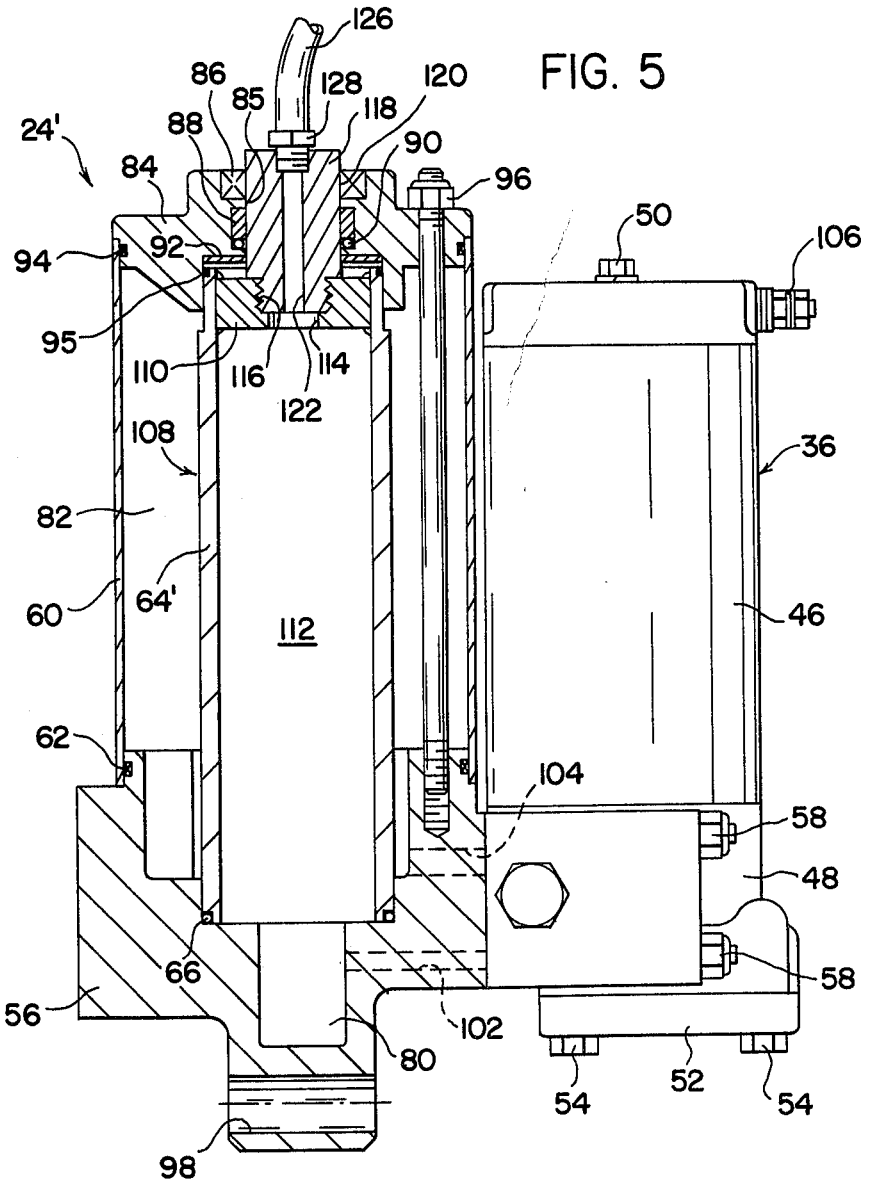
FIG. 5 is an elevational view, partially in section, of a power unit modified in accordance with the present invention to include the sleeve assembly shown in FIG. 3; and, FIG. 6 is a schematic illustration of the modified power unit in operable association with a plow blade.

Sleeve assembly 108 is shown in FIG. 5 as replacing piston sleeve 64 and the piston rod and piston assembly of the basic power unit. The thus modified power unit is designated by the numeral 24', and component parts thereof corresponding to the basic power unit illustrated in FIG. 2 are identified by like numerals in FIGS. 2 and 5. As will be apparent from FIG. 5, sleeve 64' of sleeve assembly 108 is inserted into base portion 56 and is sealed with respect thereto by seal 66. Top cover 84 secures both outer cylindrical member 60 and inner sleeve member 64' to base portion 56 by means of bolts 96 therethrough, and outer member 60 and inner sleeve 64' are sealed with respect to cover 84 as at 94 and 95, respectively. As mentioned above, the exterior dimension of nipple 118 is the same as the exterior dimension of piston rod 28, whereby seals 86, 88 and 90 within opening 85 in cover 84 sealingly engage exterior surface 120 of the nipple. While sleeve member 64' is preferably of the same dimensions and shape as piston sleeve member 64', it should be understood that such dimension and shape of sleeve 64' is not critical. It is only necessary that the replacement sleeve be adequately supported between and sealed with respect to base 56 and cover 84. This can of course be achieved with other sleeve shapes and sizes, sleeve 64' being preferred in that it requires no modifications of the base, cover or seal arrangements.

With regard to the operation of the modified power unit shown in FIG. 5, hydraulic fluid under pressure is pumped by pump 36 from reservoir 82 through fluid passage 102 into recess 80 and thus into cavity 112 of sleeve 64'. The fluid then flows through sleeve member 64' and through aperture 122 of nipple 118 into hydraulic fluid hose 126. This enables the modified power unit 24' to be operable to raise and lower a plow blade from a location remote from the front of a vehicle. In this respect, as will be seen in FIG. 6, modified power unit 24' is located remotely from plow blade 12 and vehicle front frame portion 16 and could, for example, be mounted under the hood of the vehicle. Basically, the location of modified power unit 24' is dependent only upon particular specifications of the purchaser of the unit, as a result of considerations such as longevity of the power unit and appearance of the vehicle. Except for the removal of the power unit from the support frame 22, the latter and the plow assembly can be the same and, accordingly, like numerals are used in FIG. 6 to represent corresponding parts shown in FIG. 1. When using the modified power unit, a hydraulic piston-cylinder unit is mounted between support frame 22 and lift arm 30 to lift and lower the blade. In the embodiment illustrated, this unit includes a cylinder 134 pivotally connected to frame 22 by a pin 136, and a ram member 138 extending from the cylinder and having its outer end connected to lift arm 30 by a pin 140. Hose 126 from modified power unit 24' is connected to cylinder 134 behind the piston, not shown, on the inner end of ram member 138. While not shown in FIG. 6, it will be appreciated that the plow blade assembly includes hydraulic piston-cylinder units 38 and 40 and that the latter are operatively connected with the modified power unit as they are with the power unit shown in FIG. 1.

With further regard to FIGS. 5 and 6 and the operation of the modified power unit 24', fluid under pressure flows through hose 126 to hydraulic cylinder 134 to displace ram member 138 upwardly to elevate the plow blade. When the plow blade is to be returned to its original position, hydraulic controls within pump portion 48 of the motor-pump unit connect fluid passage 102 to fluid passage 104, thus allowing the hydraulic fluid to flow from sleeve cavity 112 to reservoir space 82. When the pressurized fluid is so released from cavity 112, the weight of the plow blade displaces ram member 138 inwardly of cylinder 134, thus to lower the blade.

While the structure of the preferred embodiment has been disclosed and described in detail, it will be appreciated that other embodiments can be made and that changes can be made in the preferred embodiment without departing from the invention. Accordingly, it is to be distinctly understood that the foregoing descriptive matter is to be interpreted as illustrative of the invention and not as a limitation.

Having thus described the invention, the following is claimed:

1. In a plow blade power unit including a piston sleeve defining a hydraulic cylinder within a surrounding hydraulic fluid reservoir, piston means in said piston sleeve and including a piston rod connectable to said plow blade for raising and lowering thereof, said piston sleeve being releasably engaged between base and cover means at its opposite ends, said base and cover means also engaging an outer member defining a hydraulic fluid reservoir with said piston sleeve and said base and cover means, pump means for delivering hydraulic fluid under pressure to said piston sleeve for controlling displacement of said piston means, the improvement comprising: a replacement sleeve assembly for said piston means and piston sleeve and including a replacement sleeve having a length generally corresponding to that of said piston sleeve and adapted to be releasably engaged between said base and cover means, and a fixed end wall in said replacement sleeve including flow passageway means therethrough, for fluid flow from said pump means to enter said replacement sleeve and flow therefrom through said flow passageway means in said end wall.

2. The improvement according to claim 1, wherein said end wall is a plate member attached to said replacement sleeve.

3. The improvement according to claim 2, wherein said flow passageway means includes tubular means extending axially outwardly from said plate member.

4. The improvement according to claim 2, wherein said flow passageway means includes an aperture in said plate member and a nipple coaxial with said aperture and removably mounted on said plate member to extend axially outwardly of said plate member.

5. The improvement according to claim 4, wherein said nipple and aperture are threadedly interengaged.

6. In a hydraulic power unit for actuating a vehicle mounted plow blade, said power unit comprising: a base portion, a piston sleeve having an upper end and a lower end, said lower end sealingly and removably interengaging with said base portion, means providing fluid flow passageway means in said base portion opening into said lower end of said piston sleeve, an outer cylindrical member coaxial with said piston sleeve having an upper end and a lower end, said lower end sealingly interengaging with said base portion, a cover extending across said upper end of said piston sleeve and said outer cylindrical member and having an opening therethrough coaxial with said piston sleeve, said upper end of said piston sleeve being removably engaged with said cover, said upper end of said outer cylindrical member being removably and sealingly engaged with said cover, means releasably connecting said cover to said base portion holding said piston sleeve and outer cylindrical member therebetween, a hydraulic fluid reservoir defined by said outer cylindrical member, said piston sleeve, said base portion and said cover, said piston sleeve and said cover adapted to sealingly receive a piston and rod assembly, said piston contained in said sleeve and said rod passing through said cover opening; the improvement comprising a modified piston sleeve, said modified piston sleeve having length dimensions and upper end and lower end dimensions such that said modified piston sleeve is sealingly retained between said base portion and said cover, and an end wall assembly comprised of an end wall portion, a nipple portion and a central passageway, said end wall portion retained in sealed relationship in the upper end of said modified piston sleeve, said nipple portion passing through said cover opening and said central passageway providing a fluid flow path from the interior of said modified piston sleeve to an aperture at the outboard end of said nipple portion whereby said hydraulic power unit can supply power to a remote cylinder.

7. The device of claim 6, wherein said modified piston sleeve has outside dimensions identical to said piston sleeve outside dimensions.

8. The device of claim 6 wherein said end wall assembly, end wall portion and nipple portion are threadedly interengaged coaxial with the central passageway therethrough.

* * * * *